US007281609B2

(12) United States Patent
Del Rio Sanz et al.

(10) Patent No.: US 7,281,609 B2
(45) Date of Patent: Oct. 16, 2007

(54) ELEVATOR INSPECTION SAFETY DEVICES

(75) Inventors: Fernando Del Rio Sanz, Madrid (ES); Andres Monzon, Madrid (ES); Antonio De Miguel Urquijo, Madrid (ES); Jose Godino, Madrid (ES); Julián Cabañas Falcón, Madrid (ES); Jose Caballero, Madrid (ES)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 10/571,342

(22) PCT Filed: Sep. 15, 2003

(86) PCT No.: PCT/IB03/03960

§ 371 (c)(1),
(2), (4) Date: Mar. 10, 2006

(87) PCT Pub. No.: WO2005/026033

PCT Pub. Date: Mar. 24, 2005

(65) Prior Publication Data

US 2007/0017752 A1 Jan. 25, 2007

(51) Int. Cl.
*B66B 13/14* (2006.01)

(52) U.S. Cl. ..... 187/316; 187/401; 187/277; 187/414; 182/19; 182/113; 182/148

(58) Field of Classification Search ..... 182/13, 182/113, 148, 19; 187/200, 401, 414, 240, 187/242, 277, 316, 280; 52/30
See application file for complete search history.

(56) References Cited

U.S. PATENT DOCUMENTS 3,648,720 A * 3/1972 Kornahrens ..... 137/351
4,467,888 A * 8/1984 Hickling ..... 182/19
6,481,534 B1 11/2002 Malone, Jr.
6,543,584 B1 * 4/2003 Miyakoshi et al. ..... 187/401
2005/0217939 A1 * 10/2005 Nielsen et al. ..... 187/200
2005/0252726 A1 * 11/2005 Det et al. ..... 187/401

FOREIGN PATENT DOCUMENTS

EP 1174381 A 1/2002
GB 2158038 A 11/1985
JP 02291377 A 12/1990
JP 2002096979 A * 4/2002

OTHER PUBLICATIONS

PCT International Search Report for PCT/IB03/03960, dated May 21, 2004.
International Preliminary Examination Report for PCT/IB03/03960, dated Jan. 13, 2006.
Written Opinion for PCT/IB03/03960, dated Sep. 20, 2005.
Response to Written Opinion dated Dec. 22, 2005.

* cited by examiner

*Primary Examiner*—Peter M. Cuomo
*Assistant Examiner*—Stefan Kruer

(57) ABSTRACT

An elevator car includes a cross-head portion and a balustrade mounted to the cross-head portion. The balustrade is moveable from a retracted position for normal operation of the car to a deployed position for inspection operation of the car. The car further includes a second retractable safety device also mounted to the cross-head for preventing or limiting movement of the car. The balustrade includes at least one control for operating the elevator car during the inspection operation, the control being arranged so that the control cannot be operated when the balustrade is in the retracted position.

10 Claims, 7 Drawing Sheets

ELEVATOR INSPECTION SAFETY DEVICES

This invention relates to devices for enhancing the safety of a maintenance engineer working on top of an elevator car, particularly in a machine room-less elevator installation where overhead space is limited.

It is recognised in the art that with the increasing move to machine room-less elevator installations, there is a significant danger posed when maintenance engineers need to ride on the top of the car to carry out inspections since there may not be sufficient room to stand on top of the car when the car is at the uppermost landing.

Various proposals for enhancing the safety of engineers carrying out inspection on top of an elevator car have been proposed. For example, it is known from U.S. Pat. No. 6,481,534 to provide a vertically extending column on the top of the car which is able to withstand a force greater than the slip force of the traction drive mechanism so that the car cannot be driven up into the top of the hoist away beyond the point where the vertical column contacts the top of the hoistway. By providing the vertical column taller than the height of an adult, sufficient headroom for an engineer may be assured.

It is an object of the invention to improve safety devices provided to protect an engineer carrying out inspection of an elevator. When viewed from a first aspect the invention provides an elevator car comprising a cross-head portion, a balustrade mounted to said cross-head portion, said balustrade being moveable from a retracted position for normal operation of the car to a deployed position for inspection operation of the car, the car further comprising a second retractable safety device also mounted to said cross-head for preventing or limiting movement of the car.

Thus it will be seen that in accordance with the invention there is provided an arrangement in which the safety devices are appropriate to operation of an elevator in inspection mode, where headroom above the car is limited, are provided on an integrated cross-head. This allows such multiple safety features to be provided without significantly increasing the amount of space required on top of the elevator car and therefore maximising the space available to an engineer standing on the car. It also minimises the weight and cost thereof since only are portion of the car requires appropriate reinforcement for mounting the safety devices and in any case the cross-head is normally the strongest part of the car top already.

In preferred embodiments the second retractable safety device comprises one of a retractable bumper or a safety bolt. Most preferably both devices are provided. A bumper is a device which limits movement of the car beyond a predetermined point whilst a safety bolt is a device which substantially prevents any movement of the car. Preferably either or both of said safety devices are adapted to engage co-operating constructions attached to the elevator guide rails.

It is preferred that the balustrade lies across a substantial portion of the top of the car when its retracted position. This is beneficial in that it makes it difficult for an engineer to stand on top of the car without deploying the balustrade.

Preferably switch means are associated with at least one of the retractable safety devices to prevent inspection operation of the car until the safety device has been deployed.

In accordance with preferred embodiments of the invention, the balustrade comprises one or more controls—e.g. in a control box—for operating the car during an inspection. This has ergonomic advantages in that the controls will be raised to a comfortable working height by deploying the balustrade. It therefore obviates the need for an engineer to crouch down to reach such controls and whilst limiting the amount of vertical space required above the car during normal operation.

In particularly preferred embodiments, at least one control for operating the car during an inspection mode is arranged on the balustrade in such a way that it may not be operated while the balustrade is in the retracted position. This is advantageous in that it prevents an engineer from undertaking inspection operation until at least one safety device, namely the retractable balustrade, has been deployed.

In fact, such an arrangement is advantageous in its own right, even without the provision of multiple safety devices integrated with the cross-head, and therefore when viewed from a further aspect the invention provides an elevator car comprising a retractable balustrade moveable between a retracted position for normal operation of the elevator car and a deployed position for inspection operation of the elevator car said balustrade comprising at least one control for operating the elevator car during said inspection operation wherein said control is arranged so that it cannot be operated when the balustrade is in the retracted position.

The inspection control provided on the balustrade may be operatively associated with a switch or other means of detecting the position of the balustrade for selectively allowing operation of the control. Preferably, however, the control is physically located on the balustrade in such a way that it is not accessible in the retracted position. This is advantageous as it requires fewer additional components whilst allowing for completely reliable operation.

In a further preferred feature, a control for switching between normal and inspection operation of the elevator car is arranged such that it is not operable in the deployed position of the balustrade, but is operable in the retracted position. Thus, in the preferred embodiment there are two or two sets of controls—the first for selecting between normal and inspection operation of the elevator car and accessible in the retracted but not the deployed position of the balustrade; and the second controlling operation of the car during inspection operation and operable in the deployed position but not the retracted position of the balustrade.

As before, the control for selecting between normal and inspection operation may be operably associated with is a switch or other means of detecting the position of the balustrade but preferably the physical location of the control allows operation in the retracted position but not the deployed position of the balustrade.

The controls in accordance with this aspect of the invention are preferably provided on a control box located on the balustrade e.g. a top of car inspection box of the type known in the art. Certain preferred embodiments of the invention will now be described by way of example only, with reference to the accompanying drawings in which.

Figure 3A:
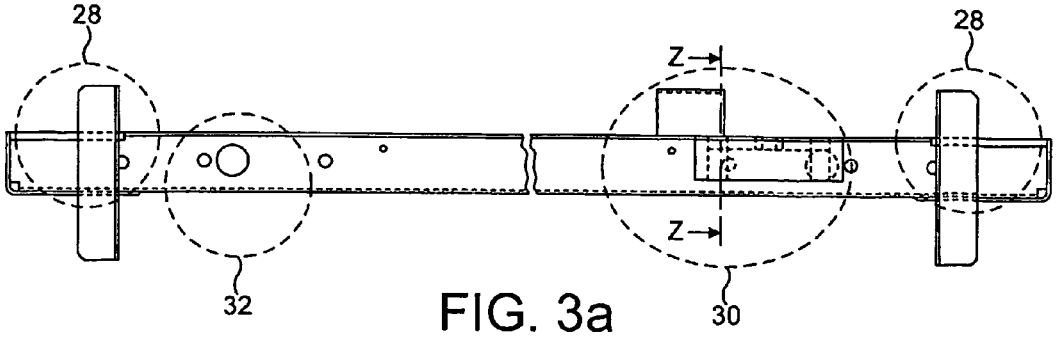
Figure 3B:
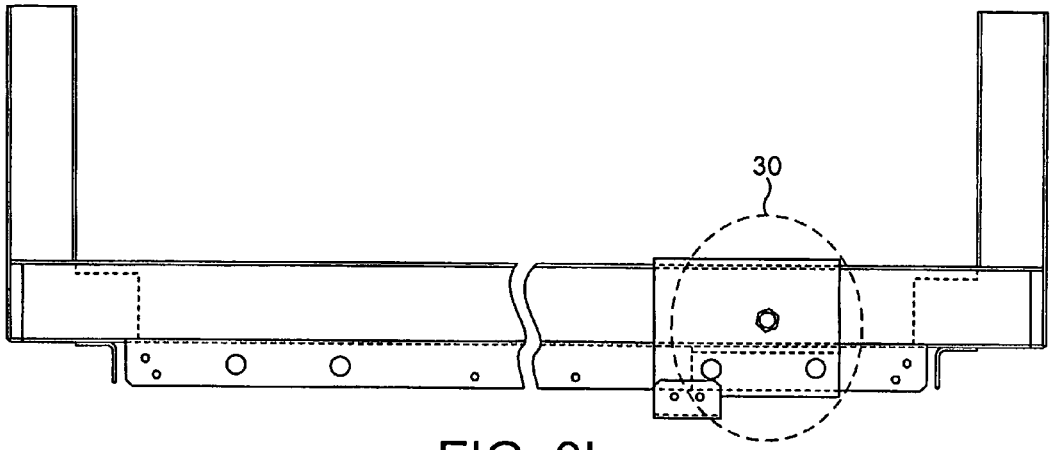
Figure 3C:
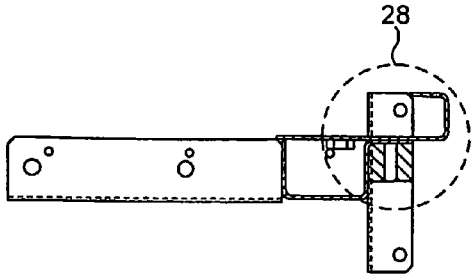
Figure 4:
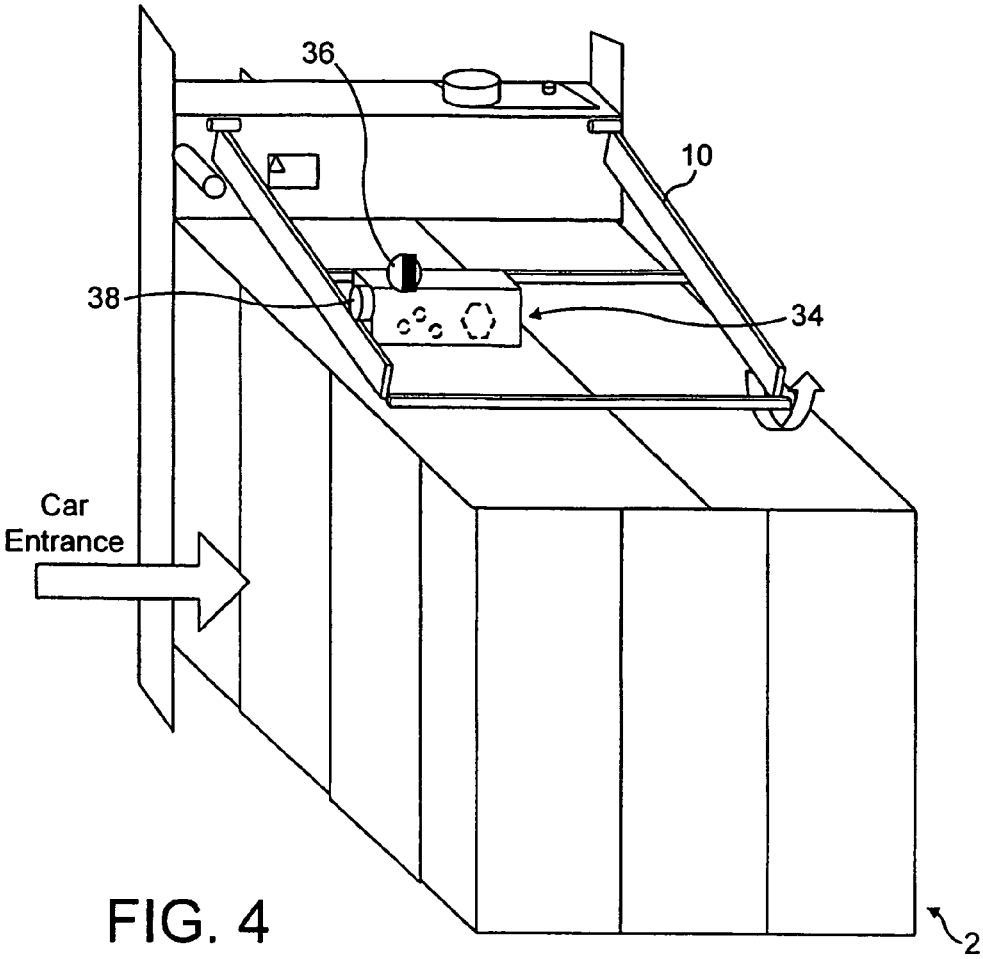
Figure 5:
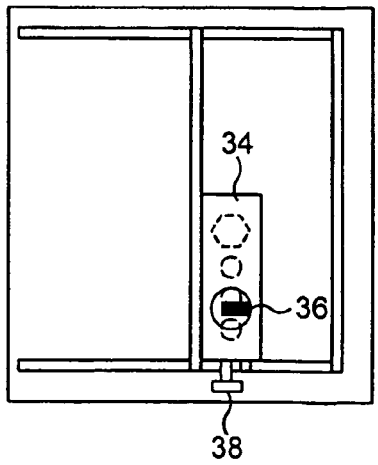
Figure 6:
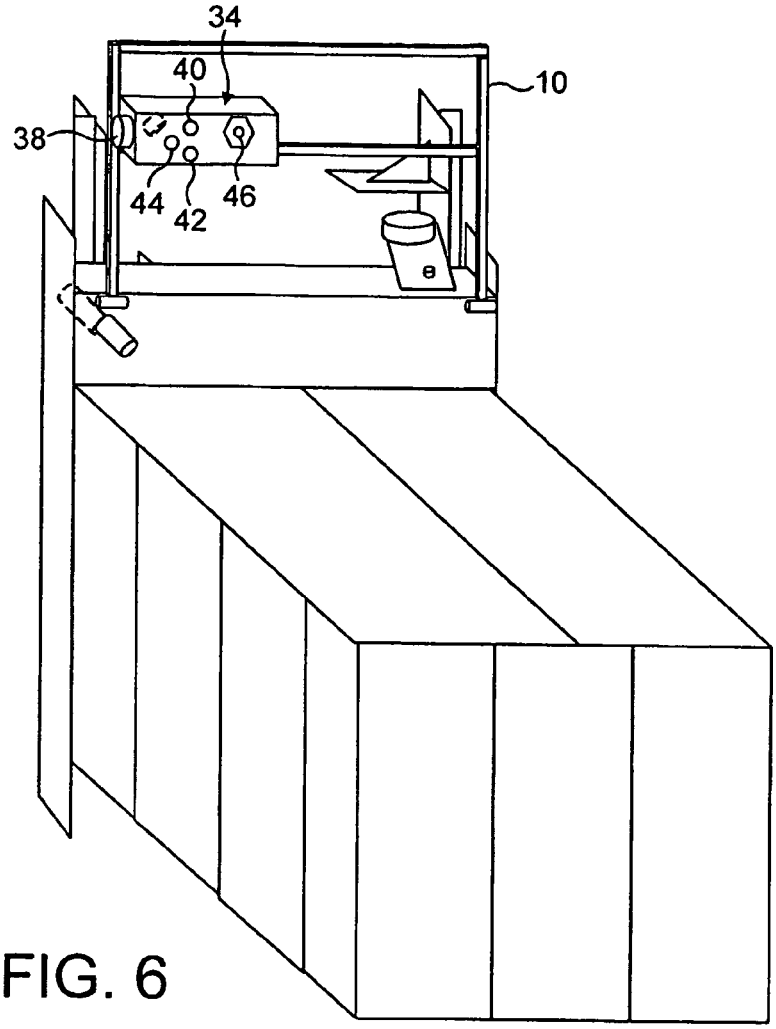
Figure 7:
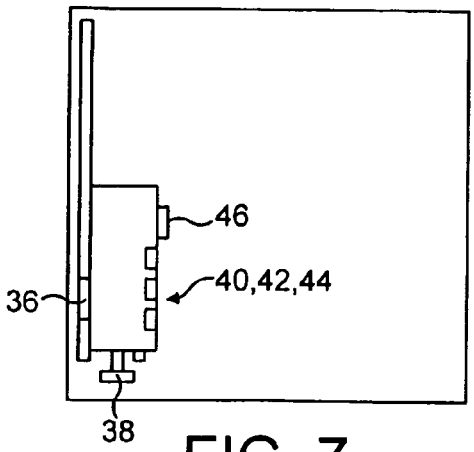
Figure 8A:
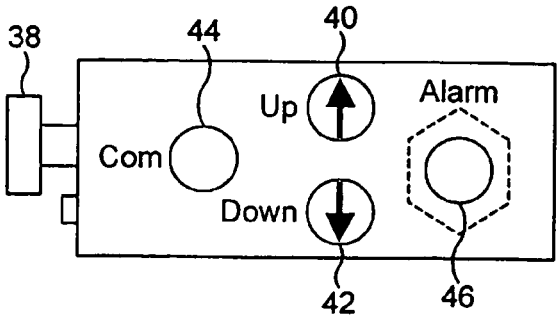
Figure 8B:
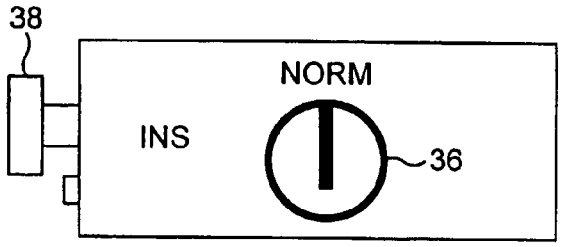
Figure 9A:
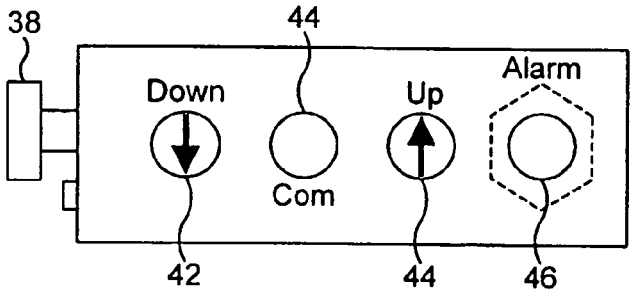
Figure 9B:
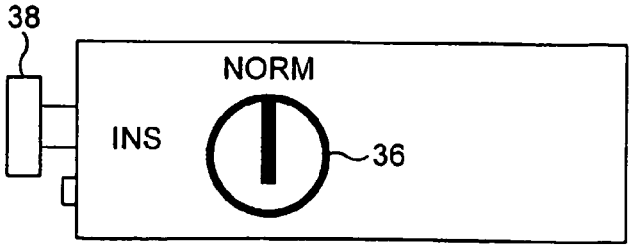
Figure 10:
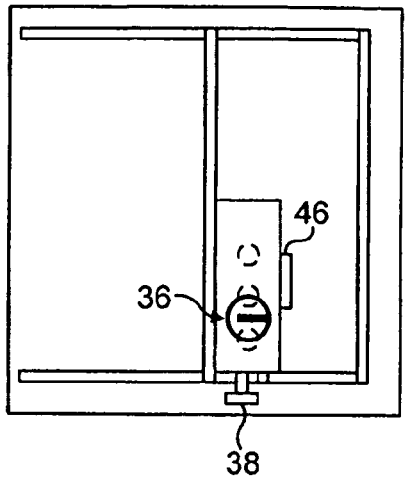
Figure 11:
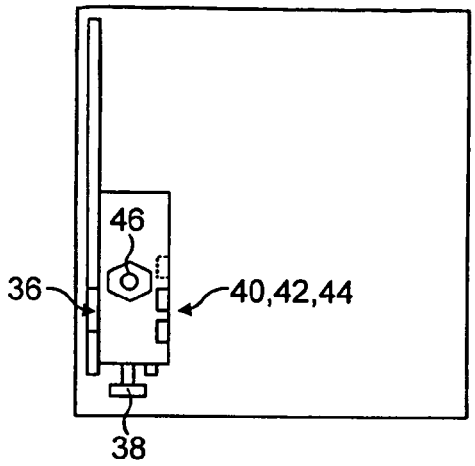
Figure 12A:
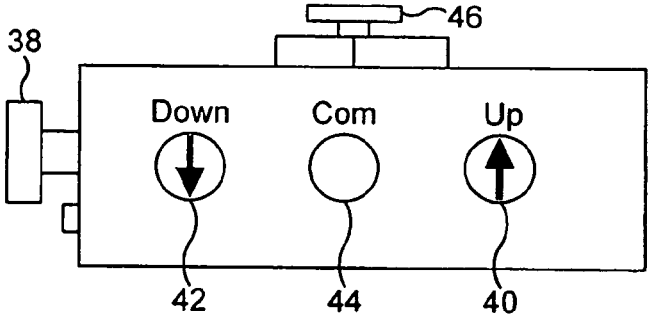
Figure 12B:
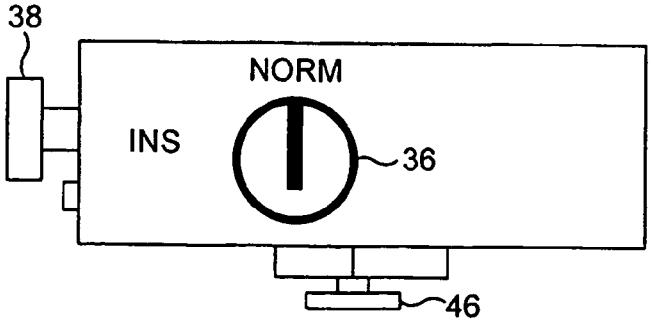

FIGS. 3*a*-3*c* are various detailed views of the elevator car cross-head;

FIG. 4 is a perspective view of an elevator car in accordance with a further embodiment of the invention with a balustrade in its retracted position;

FIG. 5 is a partial plan view of the embodiment of FIG. 4;

FIG. 6 is a perspective view of the elevator car of FIG. 4 with the balustrade deployed;

FIG. 7 is a partial plan view of the top of car inspection box on the deployed balustrade;

FIGS. 8*a* and 8*b* are top and bottom detailed views of a top of car inspection box in accordance with the invention;

FIGS. 9*a* and 9*b* are top and bottom views of another embodiment of the top of car inspection box;

FIG. 10 is a partial plan view of a retracted balustrade of another embodiment of the invention;

FIG. 11 is a partial plan view of the balustrade of FIG. 10 after deployment; and FIGS. 12*a*, 12*b* are respectively top and bottom views of the TOCI box in FIGS. 10 and 11.

Figure 1:
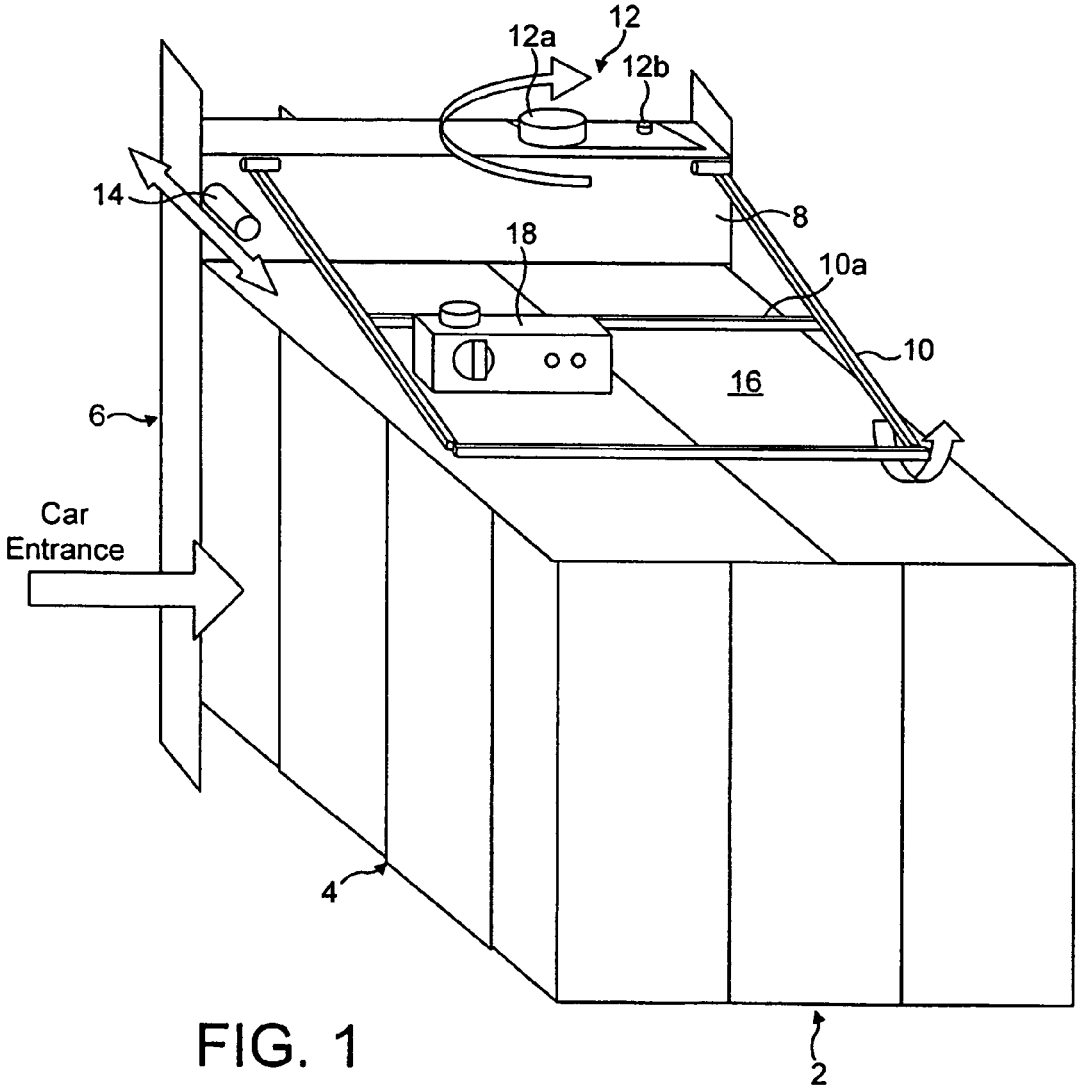
FIG. 1 is a perspective view of an elevator car in accordance with the invention with its safety features in their retracted positions.

Turning to FIG. 1, there may be seen an elevator car 2 in accordance with the invention. The overall design and construction of the elevator car 2 is standard and well known in the art and will not therefore be described in detail.

The car 2 comprises a pair of sliding doors 4 at the front thereof. At one side of the car is a cantilever mounting arrangement 6 which in use mounts the car 2 for vertical translational movement in the guide rails (not shown). At the top of the cantilever mounting arrangement 6 is a cross-head portion 8.

Three separate retractable safety devices are mounted to the cross-head 8—namely a retractable balustrade 10, a retractable bumper 12 and a safety bolt 14. Thus it will be seen that the cross-head 8 not only enhances the strength of the cantilever mounting arrangement 6, but provides convenient integral mounting for the safety devices 10, 12, 14. As will be seen more clearly in FIG. 2 (described below) this integrated mounting arrangement for the safety devices enables the top of the elevator car 16 to be substantially unencumbered with mountings etc. thereby allowing free movement of an engineer carrying out inspection whilst minimising the risk of the engineer tripping whilst moving about.

The retractable balustrade 10 comprises a rectangular frame hingedly mounted to the cross-head 8 by its two legs. When in its retracted position as shown in FIG. 1, the balustrade 10 rests on the top of the car 16. A clip, latch or the like (not shown) may be provided to retain the balustrade 10 in its retracted position. When in the retracted position shown, the balustrade lies across most of the top 16 of the car such that maneuvering on top of the car would be difficult. This provides an intuitive reminder to deploy the balustrade 10 prior to carrying out an inspection.

The retractable bumper 12 comprises a contact pad 12*a* and a base plate 12*b*. The contact pad 12*a* is mounted to the base plate 12*b* which is in turn pivotally mounted to the cross-head 8 to allow the bumper to rotate from the retracted position shown in FIG. 1 in a horizontal plane to the deployed position shown in FIG. 2. In another embodiment (not shown) the bumper is arranged to slide in and out from the cross-head. A switch (not shown) is associated with the retractable bumper preventing inspection operation of the car until it has been deployed and conversely preventing normal operation when it is deployed.

Figure 2:
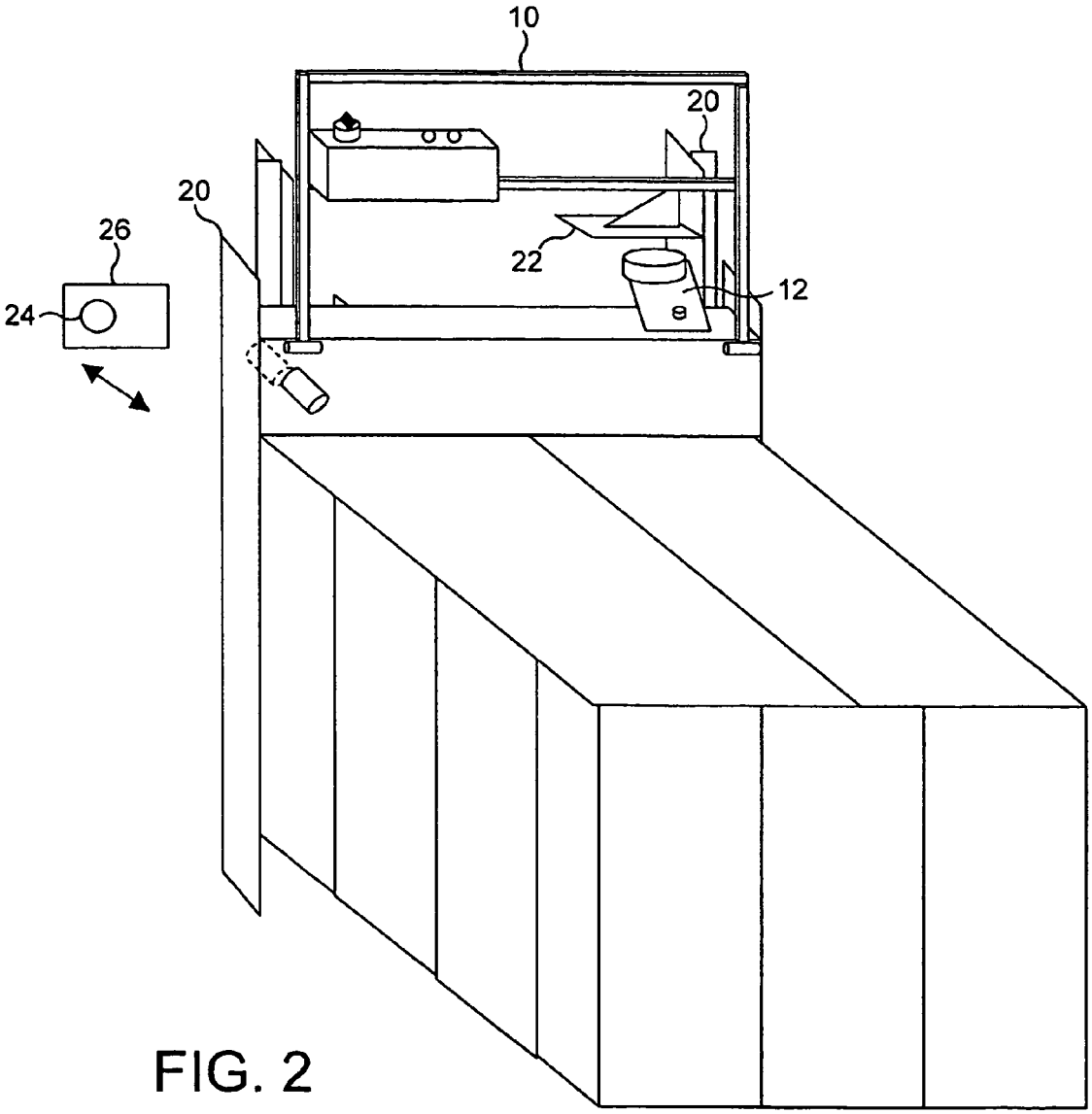
FIG. 2 is a view similar to FIG. 1 with the safety devices deployed.

The safety bolt 14 is slidingly retained in a bore through the cross-head 8 so as to allow it to be slid from the retracted position shown in FIG. 1 in which the far end of the bolt 14 does not project beyond the external surface of the cross-head 8 to the deployed position in FIG. 2 in which the bolt 14 does project proud of the cross-head 8.

FIG. 2 shows the elevator car 2 with all three of the previously described safety devices 10, 12, 14 in their deployed positions. Also shown in FIG. 2 are sections of the elevator guide rails 20.

Considering firstly the balustrade 10, it will be seen that this has been raised to an upright position. In the upright position the balustrade 10 prevents an elevator engineer from falling off the top of the car into the gap between the car and the wall of the shaft. It also provides a convenient handrail for an engineer to hold on to and presents the top of the car inspection box 18 at a convenient height for operation.

The retractable bumper 12 is rotated horizontally to extend laterally from the side of cross-head 8 so that it is in the path of an impact plate 22 attached to the rear guide rail 20. This arrangement prevents the elevator from traveling beyond the impact plate and therefore prevents the elevator from ascending dangerously close to the top of the shaft.

Finally, the safety bolt 14 is projected beyond the external surface of the cross-head 8 into an aperture 24 in a plate 26 removably fitted to the foremost guide rail 20 (shown removed in FIG. 2 for clarity). The safety bolt 14 is used for major maintenance where it is necessary or desirable to lock the elevator car in position and thereby prevent any movement thereof.

FIGS. 3*a* and 3*b* are respectively front and plan views of the cross-head and FIG. 3*c* is a section on line Z . . . Z in FIG. 3*a*. These three Figures show the mounting points for the safety devices. Thus, the pivot point 28 for the retractable balustrade 10 may be seen in FIGS. 3*a* and 3*c*; the fastening point 30 for the retractable bumper 12 may be seen in FIGS. 3*a* and 3*b* and the hole 32 for the safety bolt 14 may be seen in FIG. 3*a*.

Although not shown, safety switches may be associated with any or all of the safety devices 10, 12, 14 so as to prevent inspection operation of the elevator unless the safety devices have been properly deployed.

A further embodiment of the invention is shown in FIGS. 4-8. This is similar to the previous embodiment and a further detailed description thereof is therefore not required. The significant difference in this embodiment is in the configuration of the top of car inspection box 34. As may be seen in FIG. 4 and in greater detail in FIGS. 5 and 8*b*, when the balustrade 10 is in the retracted position shown, only two controls are accessible one is a rotary switch 36 for selecting between normal and inspection operation. This may be seen most clearly in FIG. 8*a*. The other is an emergency stop button 38 which is accessible by its location on the front end of the TOCI box 34. These two controls 36, 38 are accessible either from the landing or from on top of the car 2. However, controls for operating the elevator in inspection mode are not accessible in this is position. FIGS. 6, 7 and 8*a* show the deployed position of the balustrade 10. In this position the face of the TOCI box 34 which was facing the top of the elevator car 16 in the retracted position is now accessible. As will be seen most clearly in FIG. 8*a*, this face comprises up, down, common, and alarm push buttons 40-46 respectively which may be used for inspection operation of the elevator. It will further be appreciated that the rotary switch 36 for switching between normal and inspection operation is no longer readily accessible since it is on the face of the TOCI box 34 facing away from an engineer on top of the car. Finally, it will be appreciated that the emergency stop button 38 remains easily accessible at all times either from the landing or the top of the car by being on the end of the TOCI box 34.

FIGS. 9*a* and 9*b* are views similar to FIGS. 8*a* and 8*b* respectively showing a different possible configuration of the inspection operation push buttons 40-46.

A further embodiment is shown in FIGS. 10, 11, 12*a* and 12*b*. In this embodiment the alarm button 46 is located on the top face of the TOCI box 34 when the balustrade 10 is deployed (FIG. 11) and so the side face when the balustrade is retracted (FIG. 10). Thus the alarm button 46 is also accessible both from the landing and the top of the car, whichever position the balustrade 10 is in.

It will be appreciated by those skilled in the art that the foregoing descriptions are merely exemplary embodiments of the invention and many variations and modifications may be made within the scope of the invention.

The invention claimed is:

1. An elevator car comprising:

a cross-head portion;

a first retractable safety device in the form of a balustrade mounted to the cross-head portion, the balustrade being moveable from a retracted position for normal operation of to car to a deployed position for inspection operation of the car;

a second retractable safety device also mounted to said the cross-head for preventing or limiting movement of the car; and a third retractable safety device mounted to the cross-head wherein the second and/or third retractable safety device is configured to engage co-operating constructions attached to an elevator guide rail.

2. An elevator car as claimed in claim 1 wherein the balustrade lies across a substantial portion of a top of the car when in the retracted position.

3. An elevator car as claimed in claim 1 wherein the retractable balustrade comprises one or more controls for operating the car during an inspection.

4. An elevator car comprising:

a cross-head portion;

a first retractable safety device in the form of a balustrade mounted to the cross-head portion, the balustrade being moveable from a retracted position for normal operation of the car to a deployed position for inspection operation of the car; and a second retractable safety device also mounted to said the cross-head for preventing or limiting movement of the car, wherein the retractable balustrade comprises one or more controls for operating the car during an inspection, and wherein the at least one control for operating the ear during an inspection mode is arranged on the balustrade in such a way that the control may not be operated while the balustrade is in the retracted position.

5. An elevator car as claimed in claim 4 wherein the at least one control is physically located on the balustrade in such a way that the control is not accessible in the retracted position.

6. An elevator car comprising:

a retractable balustrade moveable between a retracted position for normal operation of the elevator car and a deployed position for inspection operation of the elevator car, the balustrade comprising at least one control for operating the elevator car during the inspection operation, wherein the control is arranged so that the control cannot be operated when the balustrade is in the retracted position.

7. An elevator car as claimed in claim 6 wherein the control is physically located on the balustrade in such a way that the control is not accessible when the balustrade is in the retracted position.

8. An elevator car as claimed in claim 6 further comprising:

a switching control for switching between normal and inspection operation of the elevator car arranged such that the switching control: (a) is not operable in the deployed position of the balustrade; and (b) is operable in the retracted position.

9. An elevator car as claimed in claim 8 wherein a physical location of the switching control for selecting between normal and inspection operation allows operation in the retracted position but not the deployed position of the balustrade.

10. An elevator car as claimed in claim 8 wherein the at least one control and/or the switching control are provided on a control box located on the balustrade.

* * * * *